US008907799B2

(12) United States Patent
McKenna

(10) Patent No.: US 8,907,799 B2
(45) Date of Patent: Dec. 9, 2014

(54) FIRE DETECTION

(75) Inventor: Cameron McKenna, Beaumaris (AU)

(73) Assignee: Flamesniffer Pty Ltd, Victoria (AU)

( * ) Notice: Subject to any disclaimer, the term of this patent is extended or adjusted under 35 U.S.C. 154(b) by 11 days.

(21) Appl. No.: 13/041,679

(22) Filed: Mar. 7, 2011

(65) Prior Publication Data

US 2012/0229283 A1 Sep. 13, 2012

(51) Int. Cl.

| | |
|---|---|
| ***G08B 17/00*** | (2006.01) |
| ***G08B 17/12*** | (2006.01) |
| ***G08B 17/10*** | (2006.01) |
| ***G08B 17/06*** | (2006.01) |
| ***G08B 25/10*** | (2006.01) |
| ***G08B 29/18*** | (2006.01) |

(52) U.S. Cl.

CPC ..... *G08B 17/06* (2013.01); *G08B 17/125* (2013.01); *G08B 17/10* (2013.01); *G08B 25/10* (2013.01); *G08B 29/183* (2013.01)

USPC ..... 340/584

(58) Field of Classification Search

USPC ..... 340/577, 588, 584

See application file for complete search history.

(56) References Cited

U.S. PATENT DOCUMENTS

| | | | | |
|---|---|---|---|---|
| 5,165,482 | A * | 11/1992 | Smagac et al. | 169/45 |
| 7,541,938 | B1 * | 6/2009 | Engelhaupt | 340/578 |
| 7,719,433 | B1 * | 5/2010 | Billman | 340/628 |
| 7,786,877 | B2 * | 8/2010 | Hou | 340/578 |
| 2002/0011570 | A1 * | 1/2002 | Castleman | 250/339.15 |
| 2005/0207487 | A1 * | 9/2005 | Monroe | 375/240.01 |
| 2007/0182812 | A1 * | 8/2007 | Ritchey | 348/36 |
| 2008/0146892 | A1 * | 6/2008 | LeBoeuf et al. | 600/300 |
| 2009/0140868 | A1 * | 6/2009 | Booth | 340/628 |

* cited by examiner

*Primary Examiner* — Brian Zimmerman
*Assistant Examiner* — Thomas McCormack
(74) *Attorney, Agent, or Firm* — Marvin Petry; Stites & Harbison PLLC

(57) ABSTRACT

A sensor unit comprising a heat resistant shell, the shell having a plurality of viewing windows spaced around the shell exterior to define a 360° view around the unit, each viewing window being optically coupled to an infrared pyro-electric sensor and an infrared thermopile sensor, the interior of the shell defining a chamber containing at least two different smoke detectors, the shell having ventilation holes communicating with the chamber and temperature sensors mounted on the unit, the shell housing at least one printed circuit board coupled to the sensors and detectors and supporting a computer and radio transmitter, and a rechargeable power source powering the printed circuit board.

8 Claims, 12 Drawing Sheets

FIRE DETECTION

This invention relates to fire detection and in particular relates to a sensor unit for use in detecting fire and a communication system that incorporates a plurality of sensor units.

BACKGROUND OF THE INVENTION

Wildfires (Bushfires) are an increasing threat throughout all areas around the globe having devastating effects including loss of human lives, wildlife, structure loss and are costing billions of dollars each year to contain, extinguish and rebuild the lost property as well as psychological effects to those directly affected by such fires.

The entire world, specifically the United States, Australia, Italy, France, China, Russia, Israel, and Greece experience major wildfires, so a cost effective solution must be sought to prevent the major increase in wildfires throughout the decades.

Current methods of detection are through visual means and only alert emergency services once the fire has consumed a vast parcel of land. Once the fire is underway, information about the fire front, including exact location, size of the front, direction and speed becomes hampered by smoke and poor visibility and cannot be viewed by air. Fire command posts have to rely on information provided at the fire front, which is limited to a particular area with fire personnel forwarding information via radio to the command post whilst continuing to fight the fire front. Aerial surveillance of the overall wildfire area is often covered by dense smoke, limited visibility and provides insufficient information regarding the actual position of the fire front.

Current Detection Methods

Current fire detection methods are largely performed through visual sightings. Such sightings are limited to daylight hours and involve a sighting of smoke from an aircraft or land-based person.

Other methods of detection are through satellite images of an area that shows a heat signature in a particular area. However due to the fact that satellites are constantly moving, detection is limited because a satellite passing over a specific area can be as infrequent as twice per day.

A further method is the use of visual cameras mounted atop mountain ridges to view a vast area awaiting the signs of smoke coming from a particular area. The limitations of camera systems is that they are only useful during the daylight hours, require human intervention to determine the image and fail to provide the exact location of the fire source as they have a limited ability to pin point the location with a 5 mile radius.

Another method of detection is through manned and unmanned aircraft that possess infrared technology to view heat sources on the ground and identify the heat source. The limitations using this type of system of detection is that aircraft rarely operate at night, flight times and manpower is expensive and limited to one area at a time—only the area currently being covered by the aircraft.

It is these issues that have brought about the present invention which relates to a solution to these issues, that is a cost effective, ground based system that incorporates multiple sensor units that form a network that can cover a specific area with the ability to detect the onset of a fire and send, real time data to pin point the source as well as provide climatic conditions such as wind speed and direction to provide a continual stream of information about the ignition source, where it is traveling to, and at what speed to enable emergency services to deploy resources to the most effective point to rapidly contain and extinguish the fire. Fire fighters, command centers and mobile command posts can continually view this stream of vital information that is ground based, located at the fire front itself to enable continued strategic decisions to be made.

SUMMARY OF THE INVENTION

According to one aspect of the invention there is provided A sensor unit comprising a heat resistant shell, the shell having a plurality of viewing windows spaced around the shell exterior, each viewing window being optically coupled to a sensor within the shell that optically senses fire, the interior of the shell defining a chamber containing at least one smoke detector, and a temperature sensor mounted on or in the unit, the shell housing a radio transmitter arranged to transmit signals actuated by one or more of the fire sensor, smoke detector or temperature sensor.

Preferably a sensor unit comprising a heat resistant shell, the shell having a plurality of viewing windows spaced around the shell exterior to define a 360° view around the unit, each viewing window being optically coupled to an infrared pyroelectric sensor and an infrared thermopile sensor, the interior of the shell defining a chamber containing at least two different smoke detectors, the shell having ventilation holes communicating with the chamber and temperature sensors mounted on the unit, the shell housing at least one printed circuit board coupled to the sensors and detectors and supporting a computer and radio transmitter, and a rechargeable power source powering the printed circuit board.

DESCRIPTION OF THE PREFERRED EMBODIMENTS

Figure 1:
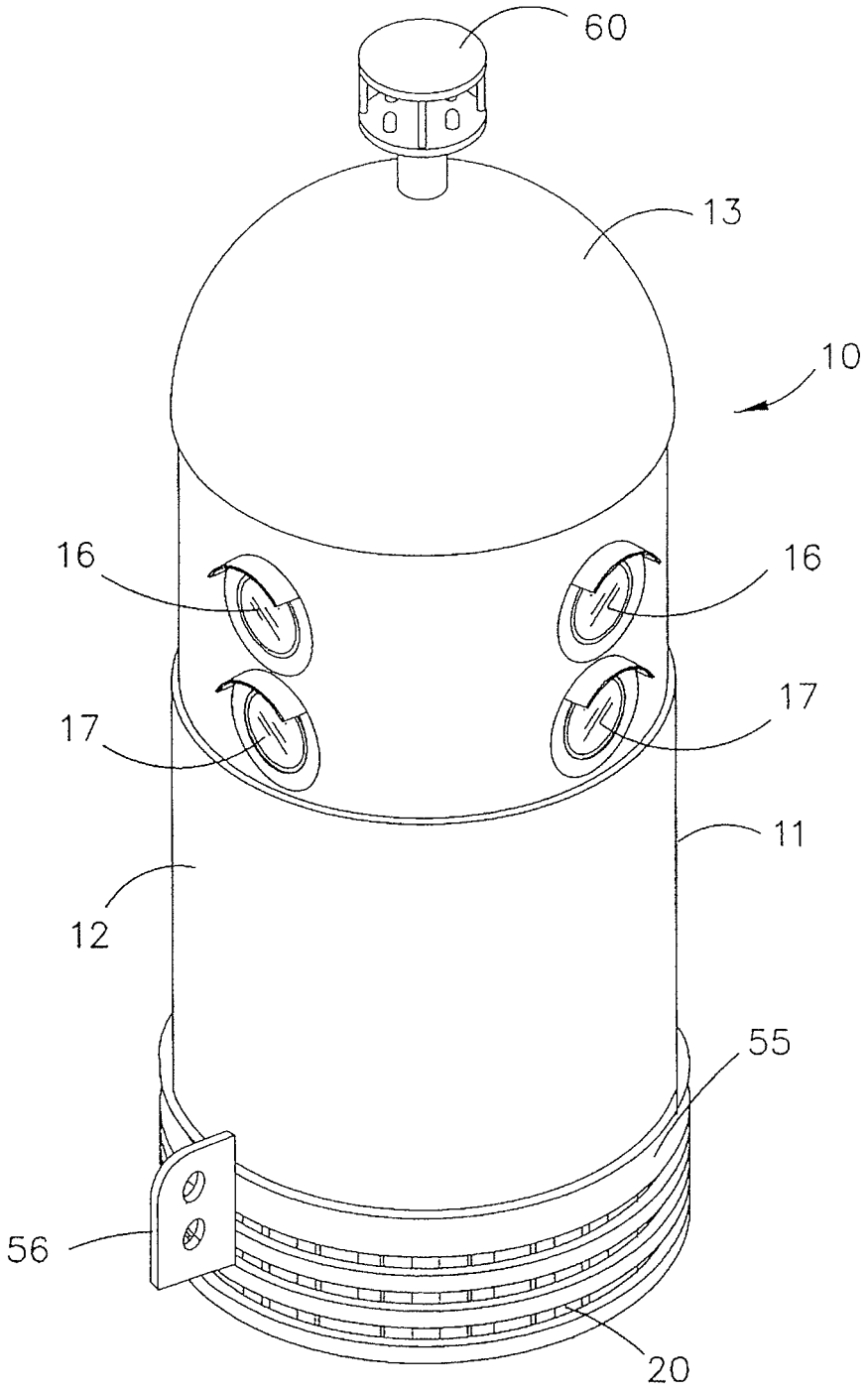
FIG. 1 is a perspective view of a sensor unit in accordance with one embodiment of the invention.

The sensor unit 10 illustrated in the accompanying drawings is manufactured in heat resistant plastics and essentially comprises an outer shell 11 with a cylindrical main body 12 and domed head 13. The shell 11 sits on top of a base structure 20 that comprises a base plate 21 that supports a platform 22 half way up the sensor unit 10 on three equally spaced pillars 23. The base plate 21 and platform 22 are designed to support the componentry that makes up the sensor unit 10.

The sensor 10 has been designed to have at least 12 different individual sensors which are described hereunder. Four infrared pyroelectric viewing sensors 26, 27, 28, 29 and four infrared thermopile sensors 30, 31, 32, 33 are housed within similarly shaped central housings 40 that are each supported on a vertical column 41 with each pyroelectric sensors 26-29 being positioned above the thermopile sensor 30-33. The outward extremity of each housing is covered by a Fresnel lens 42. Each column 41 comprises an L-shaped member that is a sliding fit on a foot structure 43 mounted on the upper platform 22 allowing the L-shaped member 41 to move inwardly and outwardly of the platform 22 thereby providing ready adjustment of the position of the sensors 25-29 and 30-33. Four columns 41 are provided each carrying a pyroelectric sensor and a thermopile sensor and the axes of these sensors are 90° apart so that the sensors view 360° around the sensor unit 10.

The external body 12 of the shell 11 is provided with plastics covered viewing windows 16, 17 that are axially aligned with the Fresnel lens 42 of each sensor. A radio antenna 50 positioned in the centre of the upper platform 22 to extend upwardly thereto in the space behind the columns. The same space also supports a printed circuit board 36 that is coupled to the infrared pyroelectric sensors 26-29 and a printed circuit board 37 that is coupled to the infrared thermopile sensors 30-33. The sensors and the printed circuit boards 36, 37 are powered by a rechargeable battery 38 which is in turn powered by a solar cell (not shown) that is attached to the exterior shell 11. The self contained power source eliminates hard wiring which would limit the positioning and location of the sensor unit.

Figure 2:
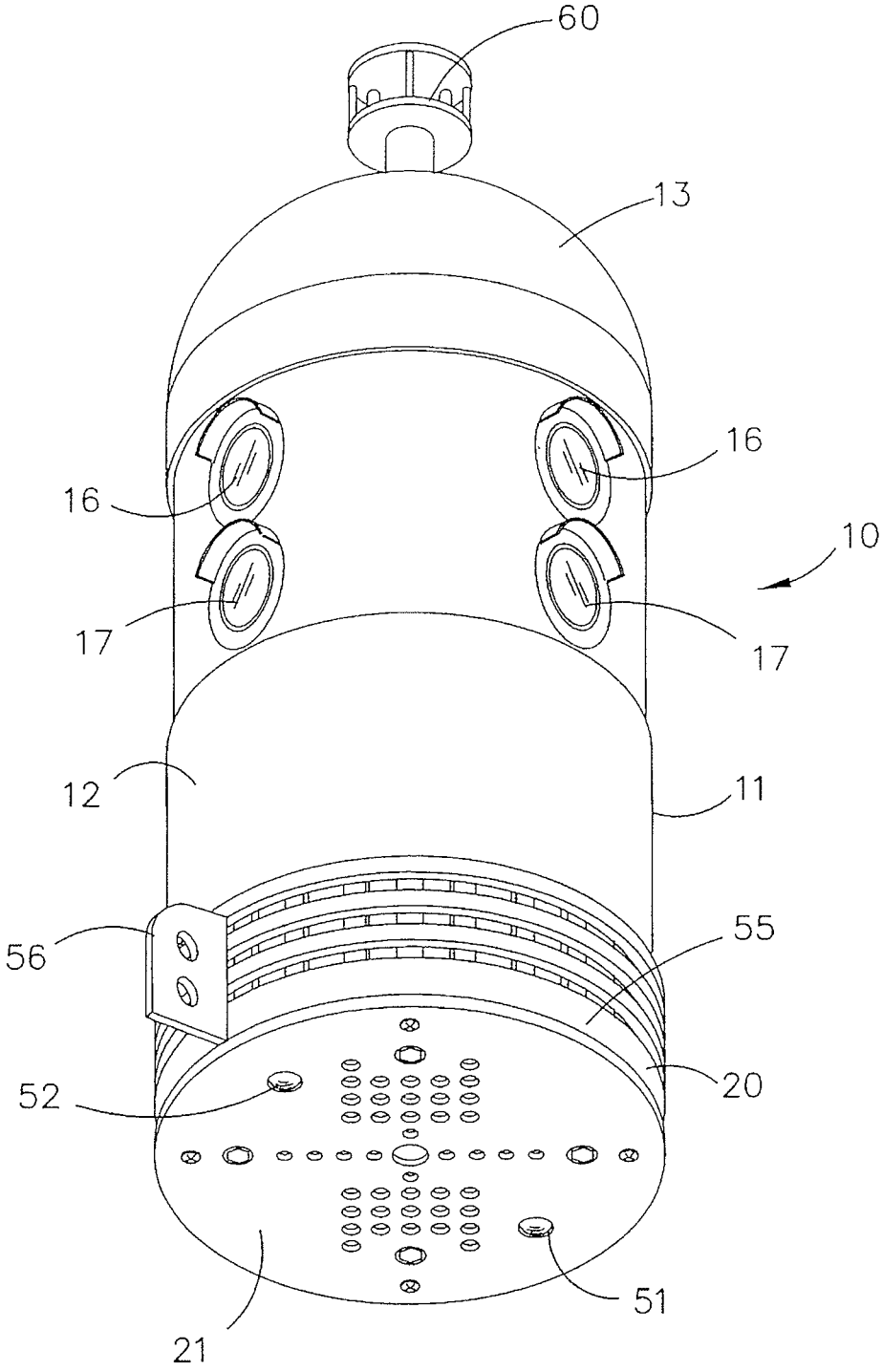
FIG. 2 is a perspective view of the sensor unit from the underside.

The space between the platform 22 and the base 21 of the unit 10 defines a sensing chamber 46 containing an ionization smoke detector 70 and a photoelectric smoke detector (not shown). The space also provides location of the battery unit 38 and two further printed circuit boards namely, a first board 48 that carries the basic electronics of the unit and includes a small computer and a radio transmitter and a second pyroelectric sensor unit 49. The printed circuit boards 48, 49 are coupled to pillars 23 that support the upper platform 22. As shown in FIG. 2 the base 21 of the unit is provided with a series of ventilation holes 53 and has two spaced external heat sensors 51, 52. The ventilation holes 53 enable the entry and ventilation of smoke so that the smoke detectors can operate.

Figure 3:
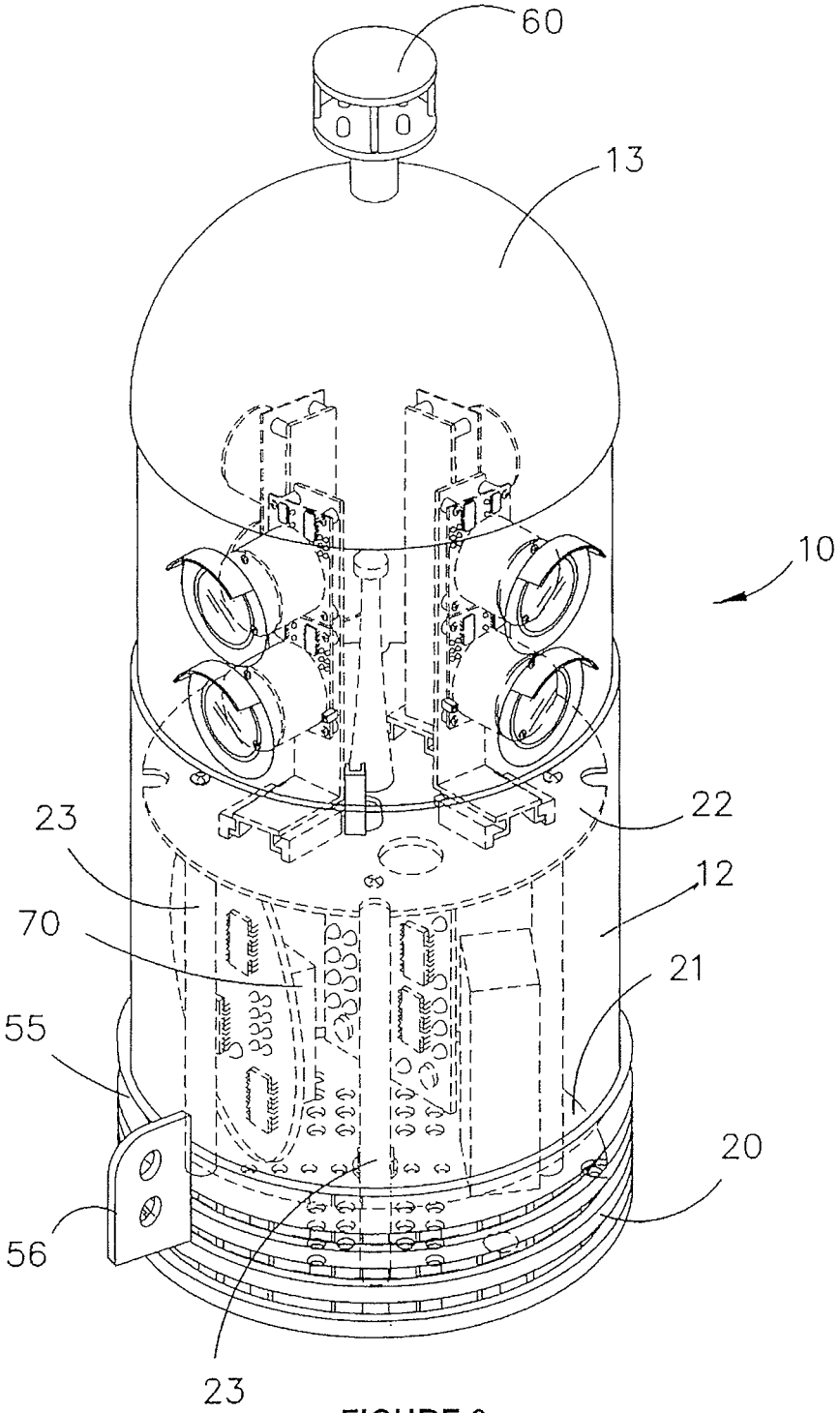
FIG. 3 is a perspective view of the unit with the internal components shown in dotted profile.
Figure 4:
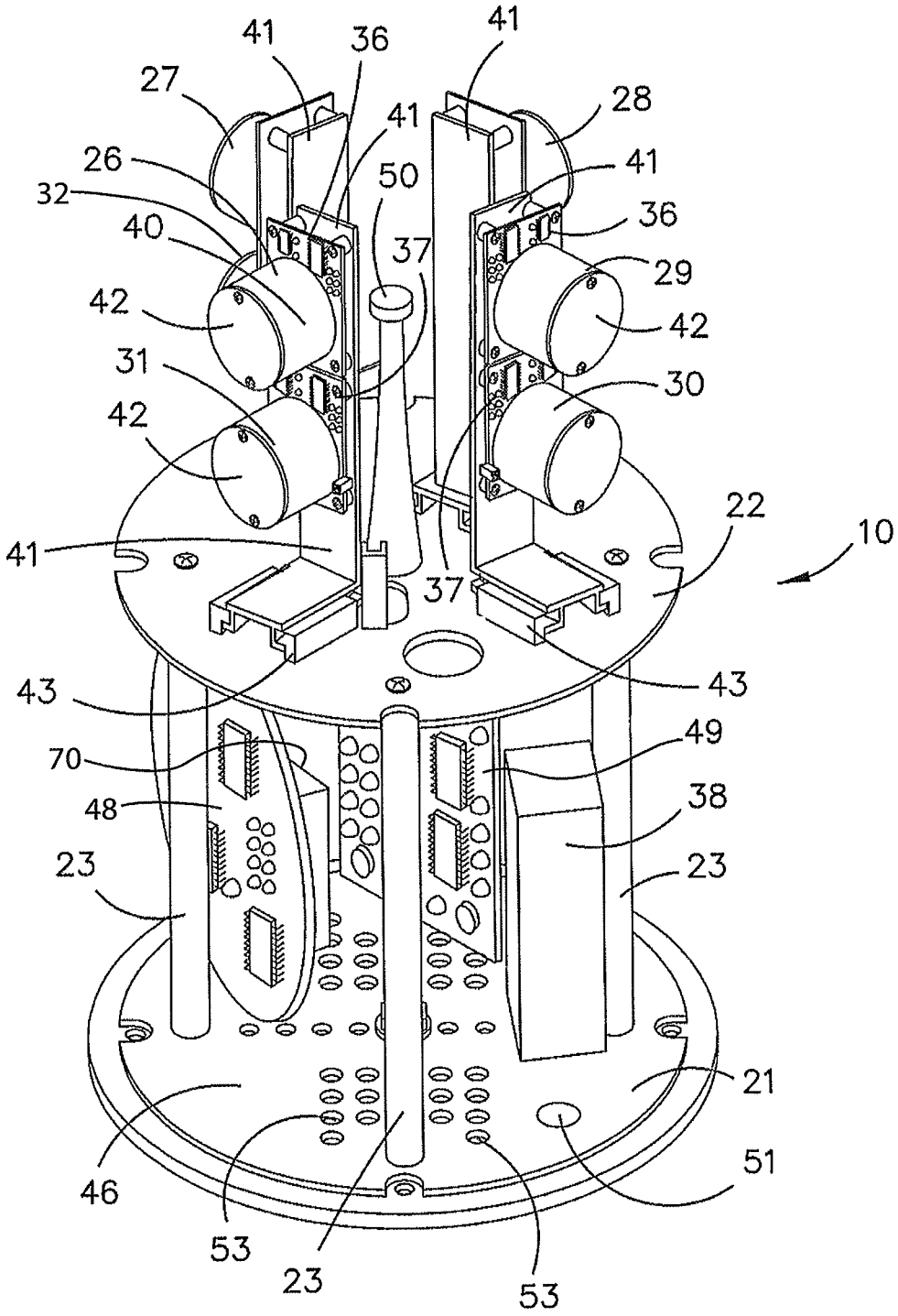
FIG. 4 is a perspective view illustrating the internal components of the sensor unit.

The sensor unit 10 as shown in FIGS. 1 to 3 also incorporates an ultrasonic wind, speed and direction sensor 60 that is attached to the domed top 13 of the unit but has its wiring extending through a conduit down the centre and to be coupled to a printed circuit board 36 or 37.

The whole sensor unit 10 is very compact with the diameter of the shell 11 being approximately 6 inches and the total height of the unit being no more than 12 inches. The base 21 of the unit has a circumferential collar 55 coupled to a connecting arm 56 which allows the unit to be bolted to a suitable support post. The solar cell (not shown) is secured to that arm 56. The heat resistant plastics ensure that the sensor unit can withstand temperatures up to 520° F.

Infrared Pyroelectric Viewing Sensors

Each sensor unit 10 contains four infrared pyroelectric sensors 26-29 that view the co2 signature of fire flame and embers. Each infrared pyroelectric sensor incorporates a Fresnel lens 42 to provide distance and magnification of the fire image and direct that image to the center of the infrared detector. Each sensor also incorporates a germanium lens that is coated on both sides to provide a specific band pass of 4300 nanometers. This band pass is specific to view the flame and ember signature. The first coating eliminates the 0-4200 bandwidth transmission that includes sunlight, which will eliminate any false alarms triggered through sun and cloud cover. The second coating eliminates transmission from 4500-7000 to eliminate false alarms triggered through motion of any type.

Infrared Thermopile Sensors

Each sensor unit 10 contains four Infrared Thermopile Sensors 30-33 that detect a heat source over 180 degrees Fahrenheit to detect the heat from a fire. Each infrared thermopile also incorporates a Fresnel lens 42 to provide distance and magnification of the heat signature provided by the fire. Each Infrared thermopile incorporates a three film coatings to eliminate false alarms from the heat emitted from the sun.

Ionization Smoke

Each sensor unit 10 incorporates the ionization smoke chamber 46 to detect the presence of smoke in the air. An ionization smoke detector (not shown) 70 uses a small amount of radioactive material to ionize air in the sensing chamber. As a result, the air chamber becomes conductive permitting current to flow between two charged electrodes. When products of combustion enter the chamber, the conductivity of the chamber air decreases. When this reduction in conductivity is reduced to a predetermined level, the alarm is set off. The ionization smoke detector is located in the lower half of the unit 10, which is vented for superior airflow through the unit. The incorporation of an ionization smoke detector is to detect smoke given off from faster flaming fires and will react quickly to this type of smoke source.

Photoelectric Smoke Detector

Each sensor unit 10 incorporates a Photoelectric Smoke Detector 71 to detect the presence of smoke produced from smoldering fires such as campsites that have not been properly extinguished. The photoelectric smoke detector consists of a light emitting diode and a light sensitive sensor in the sensing chamber 46. The presence of suspended products of combustion in the chamber scatters the light beam. This scattered light is detected and sets off the alarm.

The use of two different types of smoke detectors is incorporated in each unit 10 as they operate on different principles and therefore may respond differently to varying fire sources and conditions. The incorporation of the two provides a fail safe and instant detection of the presence of smoke from any fire source.

Heat Sensors

Each sensor unit 10 incorporates two temperature sensors 51, 52 to detect abnormally high temperatures surrounding the unit. These temperature sensors are located on the base face 21 of the unit 10 and are exposed to the environment surrounding the unit. Each sensor 51, 52 being located on the bottom face of the unit and is not affected by continual heat from sunlight.

Wind Speed and Direction

Throughout a network of sensors, wind speed and direction anemometers 60 are placed on top of the unit to detect the continual wind speed and direction at any particular location. The installed anemometer 60 is an ultrasonic unit with no moving parts that can be obstructed by debris and create operational failure. Wind speed and direction sensors are only placed on a handful of units 10 within a prescribed network or area to reduce the cost of the overall network for an area.

Communication

Each sensor unit 10 contains a specially designed circuit board 48 that incorporates a small computer and Radio Frequency engine. All sensors are attached to the board 48, which contains software specific to coordinate the signals provided by each sensor unit. Once the information has been collected, which is performed in 5, 4, 3, 2, or 1-minute intervals (depending on customer requirements), the software details the operation of each sensor and transmits the information via the radio frequency engine to other sensors units as well as several hub/gateway units located within a prescribed network. Each individual unit has the ability to transmit and receive data from other units for transmission throughout a network, effectively "bouncing" real time data around the network to the multiple hubs/gateways.

Hubs/Gateways

Hubs or gateways are communication units that receive the data from multiple sensor units and transmit the data via remote cellular modems to a designated server located anywhere throughout the globe. The installation of multiple hubs/gateways ensures that data is provided to the server from several sources should a hub/gateway be lost to a fire or experience modem communication problems. Hubs/Gateways can be installed remotely with their own power source or at existing powered infrastructure sites.

Server

All data forwarded to the server from multiple sources is collected, and processed through a web based software which displays the status of each set of sensors contained in the each sensor unit, as well as the GPS coordinates of the unit, power level and if applicable the current wind speed and direction at the unit itself.

Each unit in real time provides this information, every 5, 4, 3, 2, or 1 minute(s), 24 hours per day, 365 days per year. This constant stream of data allows the ability to continually monitor an area to ensure proper operation of each unit and reduces maintenance costs associated with continuous manual testing.

Networks

As each sensor unit has the ability to transmit and receive data, units can be placed into groups of various sizes to instantly form an entire network. This plug and play ability allows networks the ability to grow over time as units are added at various stages increasing the coverage within a particular region. Units can also be placed in different areas to form individual networks, all of which can be viewed separately to provide information to registered recipients in one area and restrict them from viewing another areas.

Ability to View Status

The information provided by the server allows registered recipients, through password protected login, to view the status of the units/network at any time from smart device or computer, anywhere in the world. Notification of alarms can be sent to emails or smart devices once a threat has been detected.

Home Defence System Operation

Sensor units 10 can operate an exterior fire protection sprinkler system by triggering the system to operate once the sensors in the unit have been triggered. This allows occupants of the property to evacuate the property with the knowledge and comfort that the exterior sprinkler system will be engaged via the sensor units, effectively protecting the property without any human intervention.

The sensor units are also key integers in a communication system described hereunder.

Figure 5:
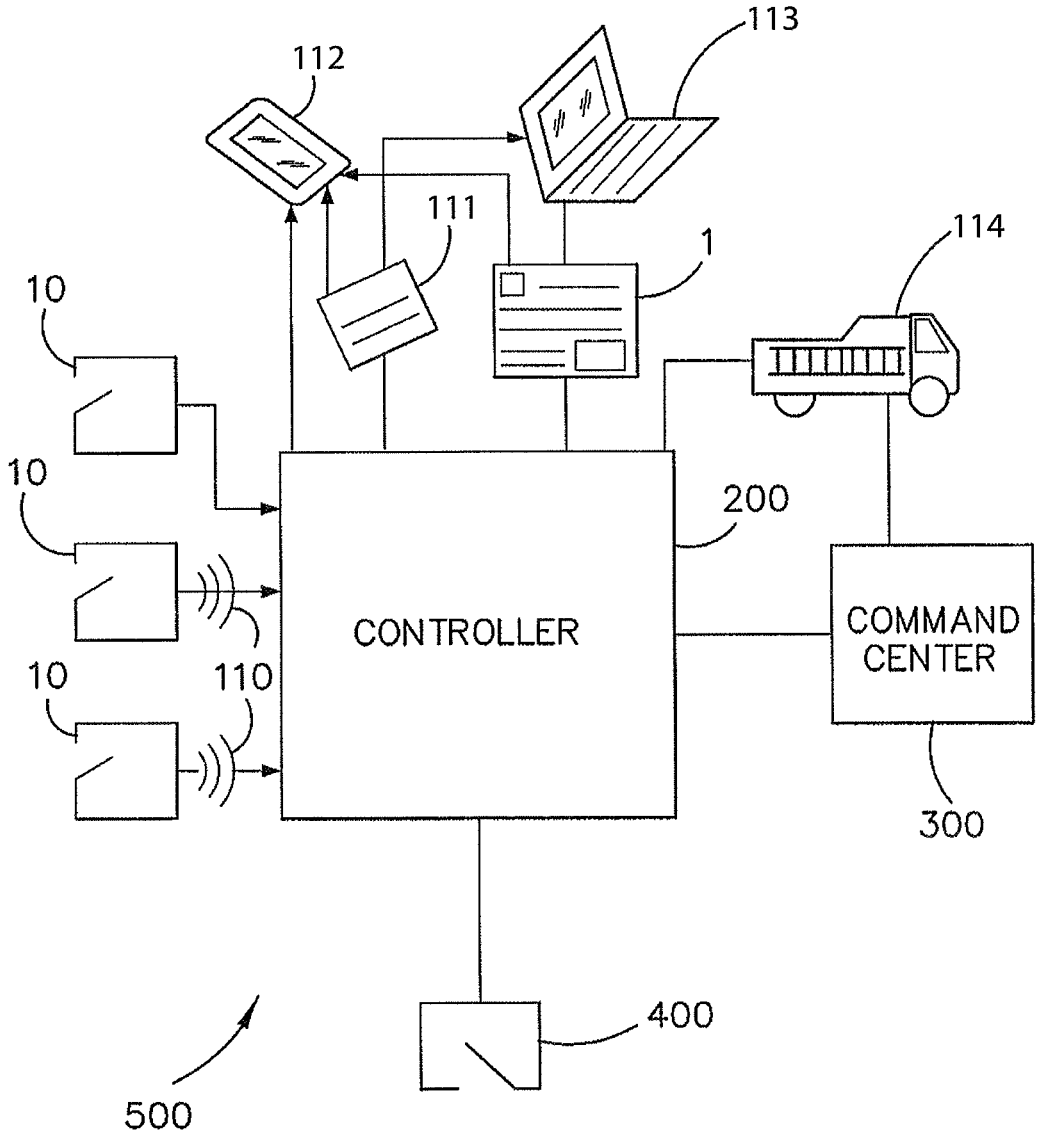
FIG. 5 is a block diagram of a system that issues electronic warning messages of a wild fire using the sensor units of the kind illustrated in FIGS. 1 to 4.

FIG. 5 illustrates a residential system 500 of stand-alone sensor units 10 for monitoring and detecting a wildfire, signaling a warning message to a controller 200 that electronically warns a homeowner and a command center 300 of a threat. The controller 200 transmits the warning message electronically in real time via an email 111, a text message to a smartphone 112, a website 1, or a special desktop application, which are non-limiting examples of electronic message formats. The homeowner and command center 300 can access and receive the warning by any device capable of receiving the electronic message, such as, for example, a smartphone 111, a desktop computer, a laptop computer 113, or other electronic devices. The types of receiving electronic devices can of course be varied, and substituted with other technologies both presently available and subsequently available, while adhering to the principles of the present invention. In one embodiment, the controller 200 sends the warning message directly to a firefighting department 114. In another embodiment, the command center 300 sends the warning message to the firefighting department 114.

A plurality of sensor units 10 are distributed around a home and monitor for smoke, temperature, and two types of infrared conditions that signal an ember or wildfire attack. It is understood that while this discussion relates generally to monitoring and reporting conditions associated with a wildfire, the system monitors and detects a fire threat to the home or the property regardless of the source of ignition, such as, for example, but not limited to, arson, lightning, and downed power lines. A sensor unit 10 can transmit the warning signal 110 to the controller wirelessly or through a wired connection 110W. The controller 200 can optionally transmit a command to activate a defence system 400, such as, for example, a dowsing system that sprays water and fire-retardant on a combustible structure.

Figure 10:
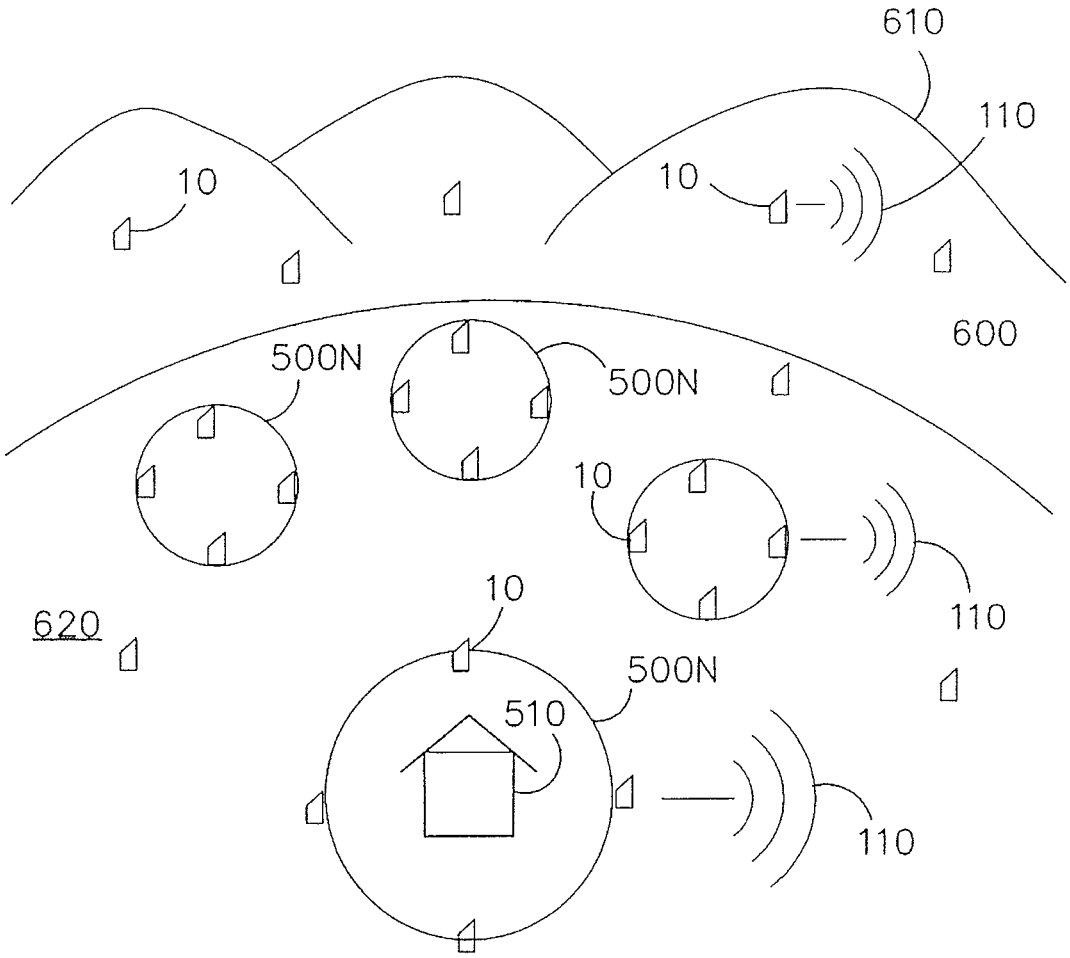
FIG. 10 is a diagram representing a plurality of sensor units diploid in a community to form a network.

When a neighborhood 600 (FIG. 10) has a plurality of homes 510 and properties, each having the residential system installed and operational around a perimeter, a distributed system for a community is created to provide a warning network. A neighborhood is defined as a plurality of homes and properties in a small geographic area. FIG. 10 illustrates how a community network 600 is formed. Each residential system becomes a node 500N on the network and transmits a warning signal 110 to the command center as described hereinabove. When more than one node 500N signals a wildfire warning, the command center pinpoints the exact location of the fire, tracks the direction and speed of the wildfire and issues an early warning over the Internet by electronic message to a plurality of members in the community network. The command center transmits the information to the firefighting department to enhance their visual tracking of the wildfire and aid in the firefighting effort. Optionally, additional sensor units 10 can be installed in undeveloped areas, such as on local open wild-land 620 and on hillsides 610 surrounding the neighborhood. Optional placement of the additional sensor units 10 increases the ability of the system to provide an early warning to the community because wildfires typically track along hillsides and open spaces.

The sensors are capable of detecting a 4 ft ember and wildfire conditions up to around 1,000 feet, although further distances can be achieved through the increasing of gain to the infra red detectors.

Figure 7:
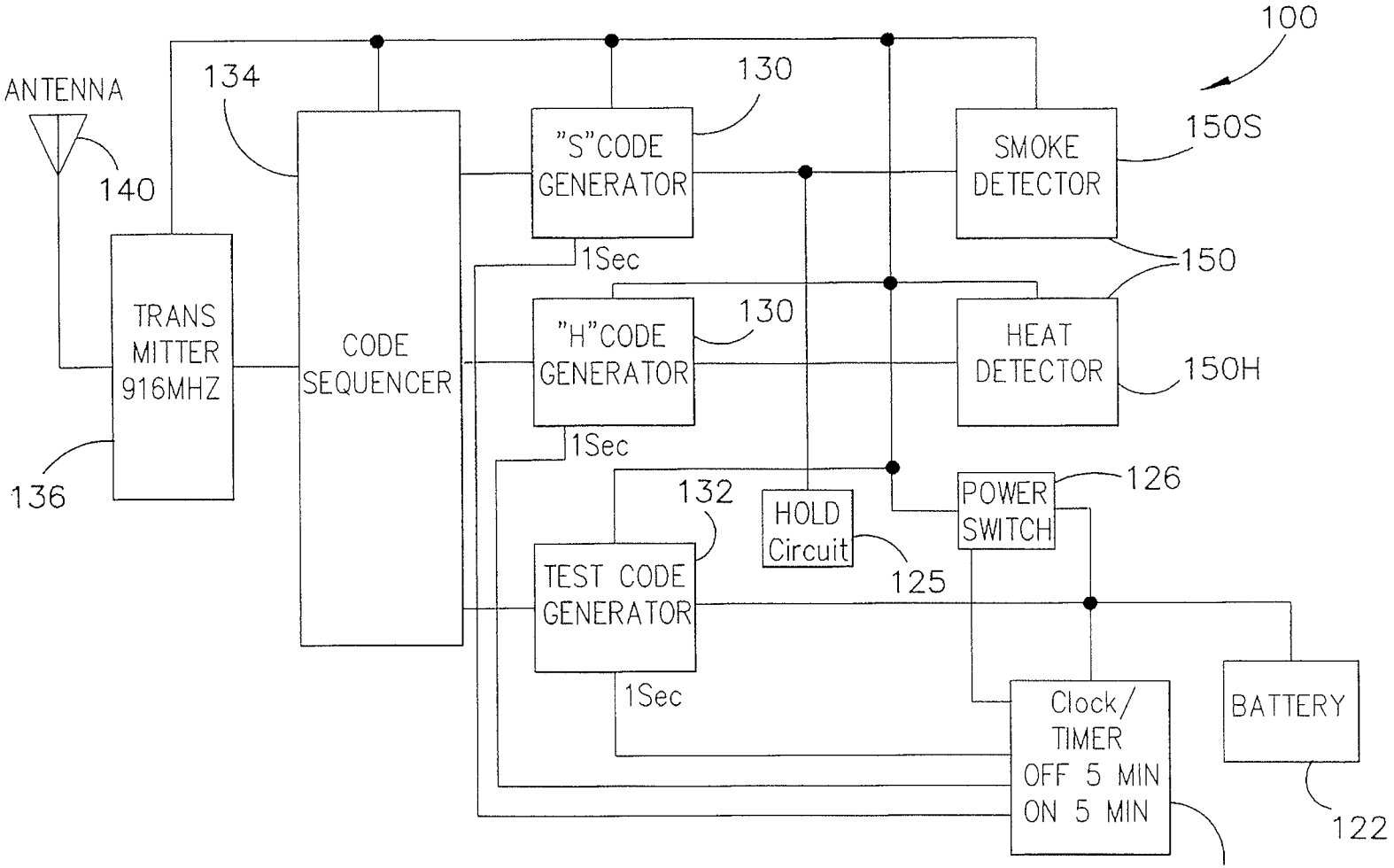
FIG. 7 is a block diagram illustrating the association of a plurality of detectors in the sensor unit.

Referring to FIG. 7, the sensor unit 100 has a timer 124 that activates the sentry for a short period of time at a set interval by using a hold circuit 125. In a non-limiting example in the illustration, the sensor unit 100 is activated for three seconds at five-minute intervals. The sensor unit 100 continues to operate at the set interval until it is turned off at a power switch 126. Each sensor 150 sends a status signal to a code generator 130 during the active period. Additionally, a test code is generated by a test code generator 132. If the sensor unit 100 does not transmit a test code within an interval slightly longer than the activation interval, for example, seven minutes, the controller will send a failure signal to the command centre to notify that the sensor unit has failed and requires inspection to determine the cause of the failure. The generated codes are sent to a code sequencer 134 and then to a transmitter 136. The transmitter 136 sends the sequenced codes to an antenna 140 of the controller via radio waves. In one embodiment, the sensor unit has a wired connection with the controller.

Figure 8:
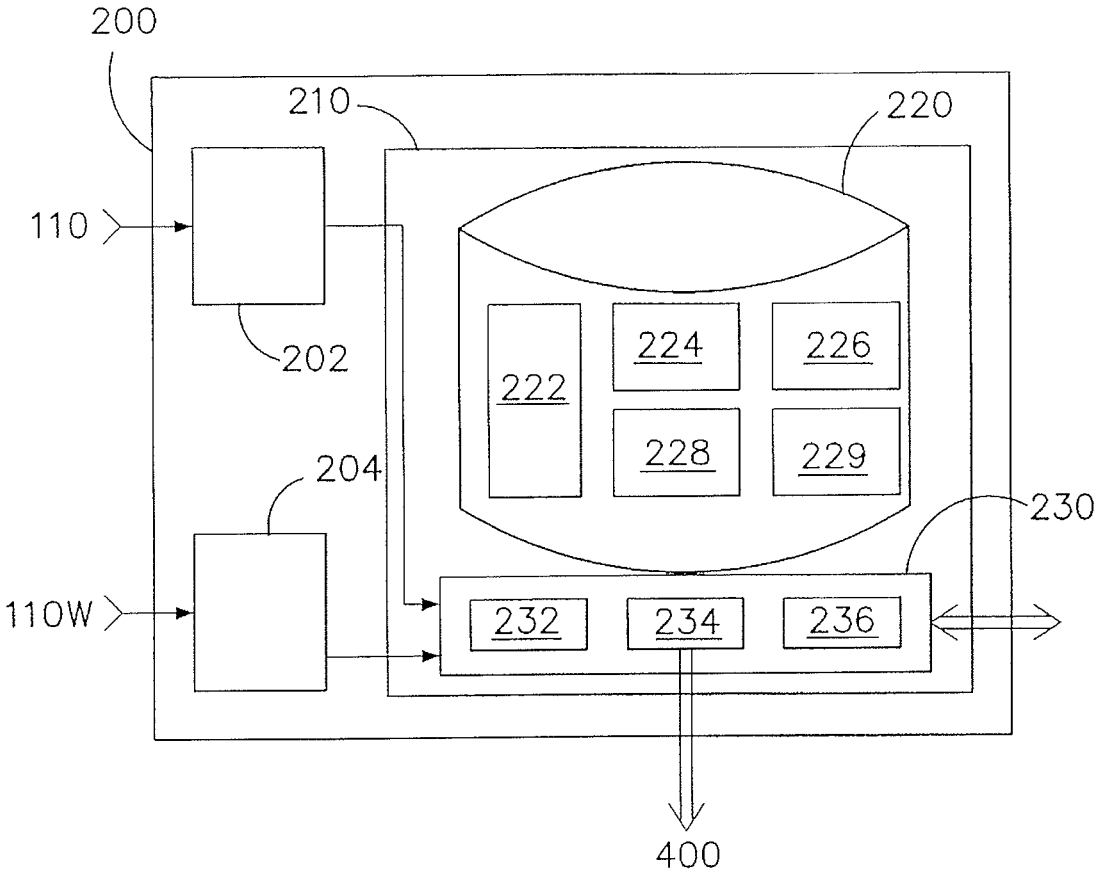
FIG. 8 is a block diagram of a controller in the system.

FIG. 8 illustrates the modules of the controller 200. The controller has a microprocessor with a storage module 220 and an input/output module 230. The storage module 220 stores a plurality of program modules such as, for example, but not limited to, an operating system module 222, a fire protection functions module 224, a web client module 226, a web server module 228 and a web page elements module 229. The input/out module 230 has an interface 232 for input from the sensor unit 10, an output interface 234 to activate an optional defence system 400 and output interface 236 to the Internet and electronic messaging media. The controller 200 has a radio receiver 202 to receive a wireless signal 110 from the sensor unit 10 and a wired sensor interface 204 with a signal conditioning circuit to receive a signal 110W from sensor unit 10 optionally wired to the controller.

Figure 6:
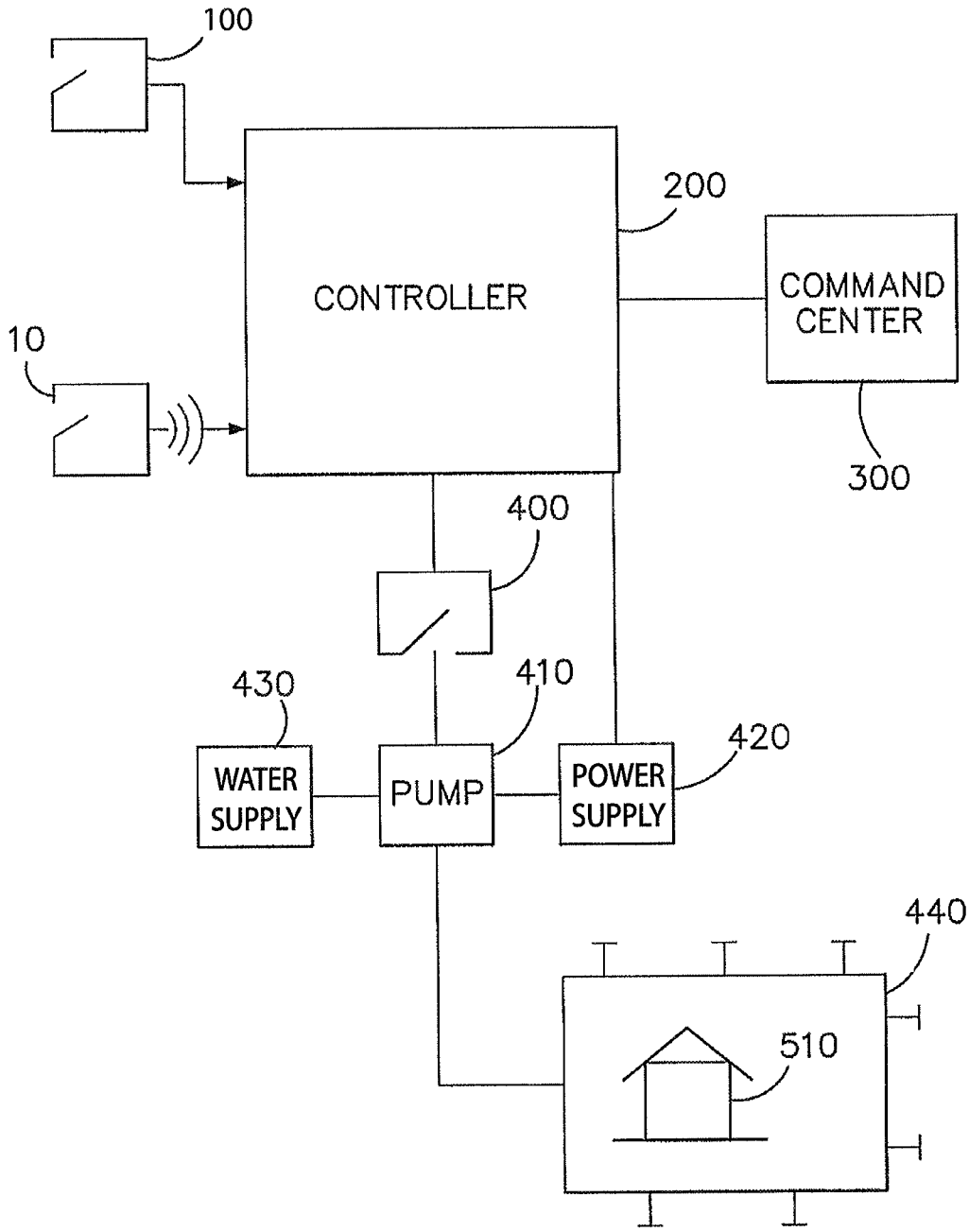
FIG. 6 is a block diagram of the system treating a home defence system.

FIG. 6 demonstrates the system when it is optionally linked with the defence system 400. The controller receives a signal from one or more of the sensor units 10 in the system. The controller tracks the direction of the fire and activates the defence system 400. When the controller 200 determines that an ember or wildfire is present, it activates a pump 410. The pump 410 and the controller 200 are powered by a power source 420 that has a power line with a backup battery/inverter system. The pump 410 begins to pump water from a water supply 430, which may be a tank, a swimming pool, or a water line. The pump pumps the water into a sprinkler system 440 that the home 510 or property with water and fire retardant. The sentries 100 continue to monitor. When additional sensors detect embers or wildfire, the controller signals the defense system 400 to douse the home 510 at an optimal time to protect the house with an amount of fire retardant and water that will remain effective during the duration of the threat. The controller 200 alerts the homeowner and the command center 300 that the defence system has been activated and provides continuing updates in real time. In one embodiment, the homeowner communicates electronically with the controller 200 to manually turn on or off the home defense system 400.

Figure 9:
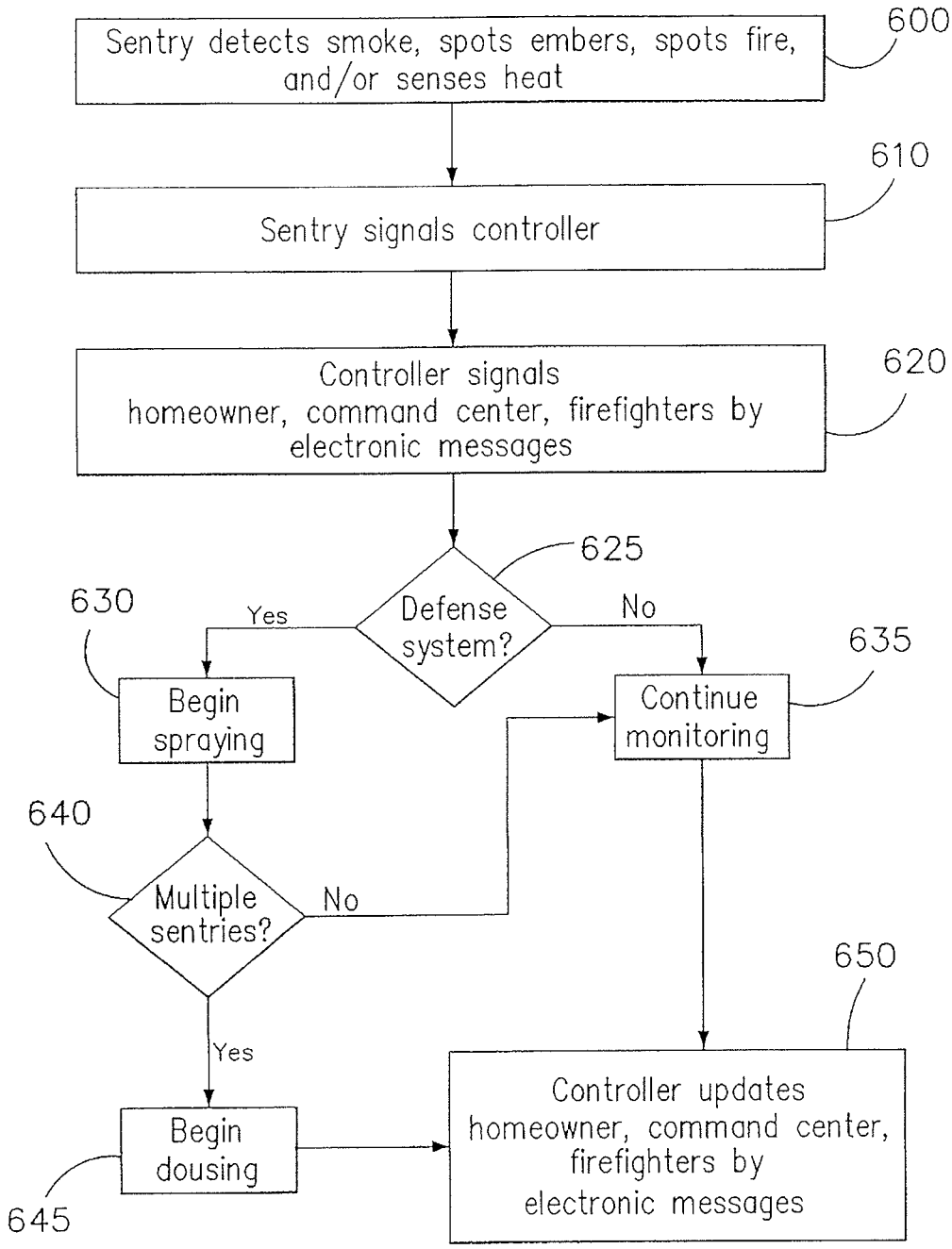
FIG. 9 is a block diagram of the process for warning a home owner, a command centre and a fire fighting department.

The process is described by way of a block diagram in FIG. 9. A sensor unit 10 detects smoke, spots embers, spots fire and/or senses heat, indicating fire 600. The sensor unit 10 signals a warning to the controller 610 that indicates that embers and advancing wildfire are present within the range of the sensors. The controller communicates with the homeowner, command center and firefighting department, directly or indirectly, of the potential danger by electronic messages 620. If the optional defence system is installed 625, the controller activates the defence system at a preliminary spraying level 630. The controller continues to monitor the condition and operation of the sensor unit 10 and sends electronic message 635 and the controller updates the homeowner, central command and firefighters by electronic messages 650. When the control receives warning signals from multiple sensor unit's 640, signaling advancing wildfire, it calculates the optimal time to fully activate the optional defense system to douse the home 645. The controller continues to monitor the condition and operation of the defence system and sensor units and sends electronic messages updating the homeowner, central command and firefighters 650. If the optional defence system is not installed, the controller continues monitoring 635 and updating the homeowner, command center and firefighters by electronic messages 650.

Figure 11:
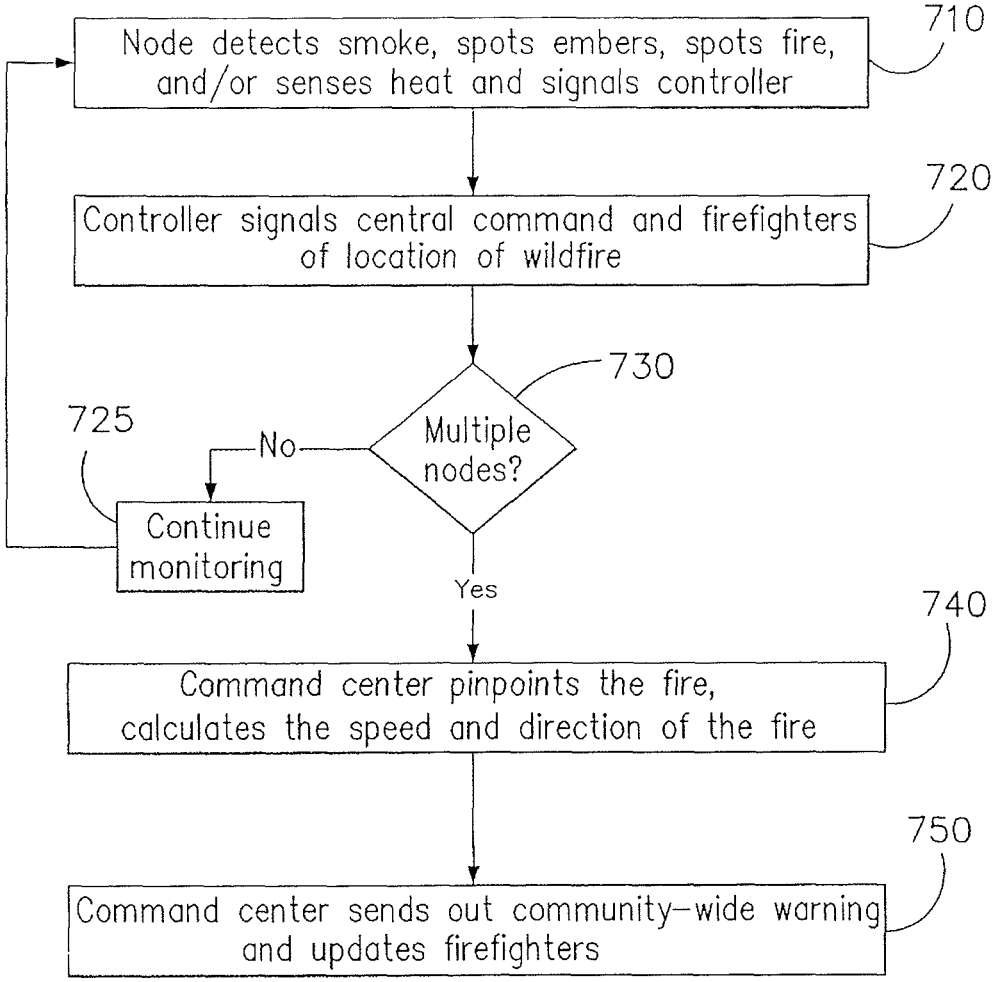
FIG. 11 is a block diagram of the process for warning a plurality of home owners in a community and a fire fighting department by the command centre in the community network.
Figure 12:
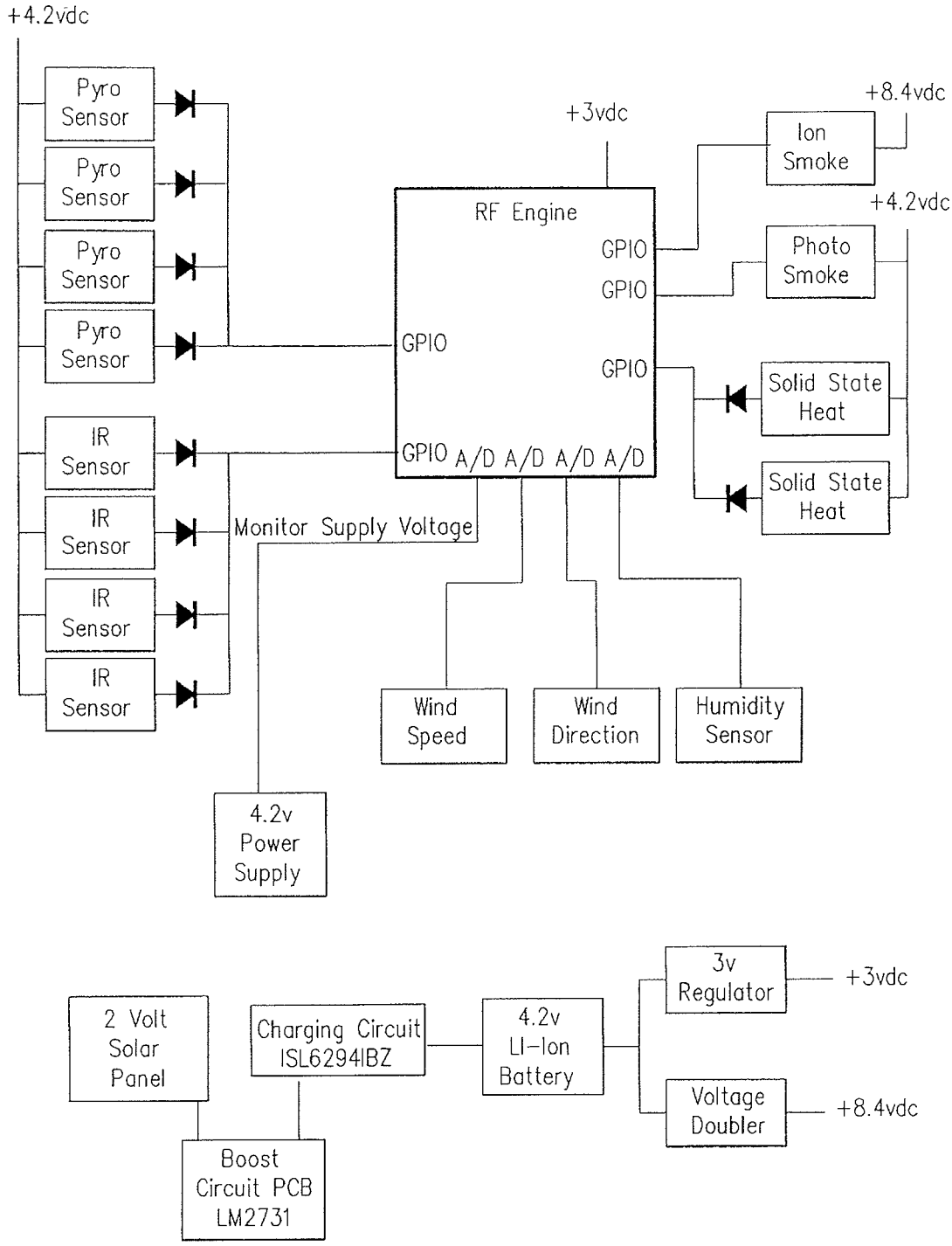
FIG. 12 is a block diagram illustrating the association of the sensors and a radio frequency engine.

FIG. 11 describes the process in a block diagram of a community network system. A sensor unit 710 signals presence of embers and wildfire by detecting smoke, spotting embers, spotting fire and/or sensing heat and signals a warning to the controller 720. The controller signals the command center 740. When one sensor unit signals a warning, the command center notifies the firefighting department and continues to monitor the network 725. When multiple sensor units signal a warning 730, the command center pinpoints the fire, calculates the speed and direction of the fire 740. The command center notifies the firefighting department and warns residents to evacuate, giving an early warning and allowing more time for evacuation 750.

Thus there is provided a distributed system that monitors for evidence of an approaching wildfire through a plurality of sensor unit's and sends an electronic message to a homeowner and command center of the danger of fire. A plurality of the distributed systems forms a community network that warns the members of the network of an approaching wildfire.

The invention claimed is:

1. A sensor unit comprising:

an outer shell made of a heat resistant material, the outer shell enclosing the sides of the sensor unit completely around 360 degrees and including a top closure which encloses the top of the sensor unit, the sensor unit having a plurality of windows mounted in the sides of the outer shell and spaced circumferentially around the outer shell to provide a 360 degree view around the sensor unit, an infrared pyroelectric fire sensor and an infrered thermopile sensor located within the outer shell, each of the viewing windows being optically coupled to the fire sensor and the thermopile sensor, at least two different smoke detectors located in a chamber within the outer shell, the shell having ventilation holes communicating with the chamber, a temperature sensor mounted on or in the outer shell, and, at least one printed circuit board located within the outer housing and coupled to the sensors and detectors and supporting a computer and a radio transmitter, and a rechargeable power source powering the printed circuit board.

2. The sensor unit according to claim 1 wherein a solar panel is secured to the exterior of the sensor unit to recharge the power source.

3. The sensor unit according to claim 1 wherein four windows are equally spaced around the shell.

4. A sensor unit according to claim 1 including an adjustable pulsing means to switch on the sensors and detectors at predetermined intervals.

5. The sensor unit according to claim 1 wherein an anemometer is secured to the unit to measure the direction and speed of wind outside the unit.

6. A sensor unit comprising:

an outer shell made of a heat resistant material, the outer shell enclosing the sides of the sensor unit completely around 360 degrees and including a top closure which encloses the top of the sensor unit, the sensor unit having a plurality of windows mounted in the sides of the outer shell and spaced circumferentially around the outer shell to provide a 360 degree view around the sensor unit, an infrared pyroelectric sensor located within the outer shell to detect a flame signature through wavelength transmission at approximately 4300 nanometers, each of the viewing windows being optically coupled to the infrared pyroelectric sensor, at least two smoke detectors located in a chamber within the outer shell, which detect both smoke created from faster flaming fires and slow smoldering fires a temperature sensor mounted on or in the out shell, the shell having ventilation holes communicating with the chamber a radio transmitter mounted on or within the outer shell and arranged to transmit signals actuated by one or more of the fire sensor, a smoke detector or a temperature sensor, an anemometer mounted on the outer shell to measure wind speed and direction, a central processing unit located within the shell and coupled to the sensors and detectors and a rechargeable power source powering the central processing unit to produce a ground based system that incorporates multiple sensor units that form the network that can cover a specific area with a minimum radius of 1,000 feet.

7. A system to monitor and detect fires through the incorporation of multiple sensors according to claim 6 operating simultaneously comprising multiple pyroelectric sensors that recognize the CO2 signature of a flame which is specifically viewable at approximately 4300 nanometers eliminating false alarms of sunlight in the 0-4200 nanometer wavelengths and movement experienced at 4500-7000 nanometer wavelengths, the inclusion of infrared thermopiles to detect a heat source over 180 degrees Fahrenheit and the presence of smoke and suspended particles through incorporation of two smoke detectors, the sensors all operating differently to detect varying fire sources and conditions, to ensure detection of fire ignition without false alarm, the sensors being coupled in a network, designed to be exposed to conditions at the fire source to provide signals indicating the presence and location of a fire and provide continuous, real time, localised, ground-based climatic conditions surrounding the fire, to provide an understanding of current and potential fire behaviour to aid fire fighter safety and the ability to effectively co-ordinate fire fighting resources to combat the fire.

8. The system according to claim 7 wherein the network includes a command center that collects and processes all data collected from the multiple sensor sources and displays the status of each set of sensors contained in each sensor unit, as well as the GPS co-ordinates of the unit, power level and current wind speed and direction at the unit itself.

* * * * *